United States Patent [19]

Gyovai

[11] Patent Number: 4,856,786

[45] Date of Patent: Aug. 15, 1989

[54] SPHERICAL PUZZLE TOY

[76] Inventor: Geza Gyovai, Höglerstrasse 53, Dübendorf, Switzerland

[21] Appl. No.: 163,302

[22] Filed: Mar. 2, 1988

[30] Foreign Application Priority Data

Mar. 23, 1987 [CH] Switzerland ..... 1086/87
Sep. 24, 1987 [CH] Switzerland ..... 3704/87

[51] Int. Cl.[4] ..... A63F 9/08
[52] U.S. Cl. ..... 273/153 S
[58] Field of Search ..... 273/153 S

[56] References Cited

U.S. PATENT DOCUMENTS 4,441,715 4/1984 Titus ..... 273/153 S

FOREIGN PATENT DOCUMENTS

G8106197.8 9/1981 Fed. Rep. of Germany ... 273/153 S
3127757 2/1983 Fed. Rep. of Germany ... 273/153 S
3206561 10/1983 Fed. Rep. of Germany ... 273/153 S
1227223 4/1986 U.S.S.R. ..... 273/153 S
1227225 4/1986 U.S.S.R. ..... 273/153 S

*Primary Examiner*—Anton O. Oechsle
*Attorney, Agent, or Firm*—Helfgott & Karas

[57] ABSTRACT

A combination toy in the form of a spherical body is proposed, which is subdivided into great circle and meridian sectional planes. On the outer spherical body surface is provided a plurality of sliding parts operatively connected with holding and connecting members. The toy essentially comprises an inner spherical body, a central spherical body formed from several segmental parts and an outer spherical body formed from several segmental parts. The outer spherical body is provided on its outside with spaced pockets, which form guideways for the sliding parts oriented towards the great circles. The individual sliding parts having representation portion applies to the outside and which, for representing a picture, figure or game combination, are displaceable along the great circles, while being reciprocally adjustable along the meridians.

15 Claims, 6 Drawing Sheets

SPHERICAL PUZZLE TOY

BACKGROUND OF THE INVENTION

The invention relates to a combination toy, particularly to a a toy constructed as a spherical body with several sliding parts subdivided into great circle and meridian sectional planes and engaging with correspondingly associated and constructed holding and connecting elements. The sliding parts are adjustable for assuming a specific position with respect to one another on the spherical body surface along the individual great circles and the individual meridians.

WO No. 81/01638 discloses a toy having the external shape of a sphere or ball and subdivided into a plurality of sliding parts by cuts along the meridians and cuts along the great circles. The individual sliding parts arranged on the spherical surface and operatively interconnected by means of a functional device are on the one hand displaceable over the entire spherical surface about a fictitious rotational axis along the great circles and on the other hand the sliding parts located in the lower or upper region can be rotated with respect to one another along the meridians for attaining a desired playing combination by securing the sliding parts not to be adjusted. The functional device arranged within the spherical body and formed by support, connecting, spreading and holding elements has a relatively complicated construction.

SUMMARY OF THE INVENTION

The primary object of the present invention is to provide a combination toy of the aforementioned type which, while retaining an almost unlimited number of combination and displacement variants, has a functionally reliable construction.

According to the invention this object is attained in that the toy substantially comprises a first, inner spherical body, a second central spherical body, a third, outer spherical body and the sliding parts adjustably arranged thereon. The central spherical body and the outer spherical body are in each case subdivided into an equal number of segmental parts. In order to enable the desired movement along the meridians, these bodies are operatively interconnected by means of corresponding holding and directing elements. Each individual segmental part of the outer spherical body is provided on its outside with spaced pockets which, in the assembled state, form guideways oriented in the circumferential direction and in which are guided the sliding parts adjustable along the great circles.

Additional objects, advantages and features of the invention will either be explained or will become apparent to those skilled in the art hereinafter.

DETAILED DESCRIPTION OF THE PREFERRED EMBODIMENTS

Figure 1:
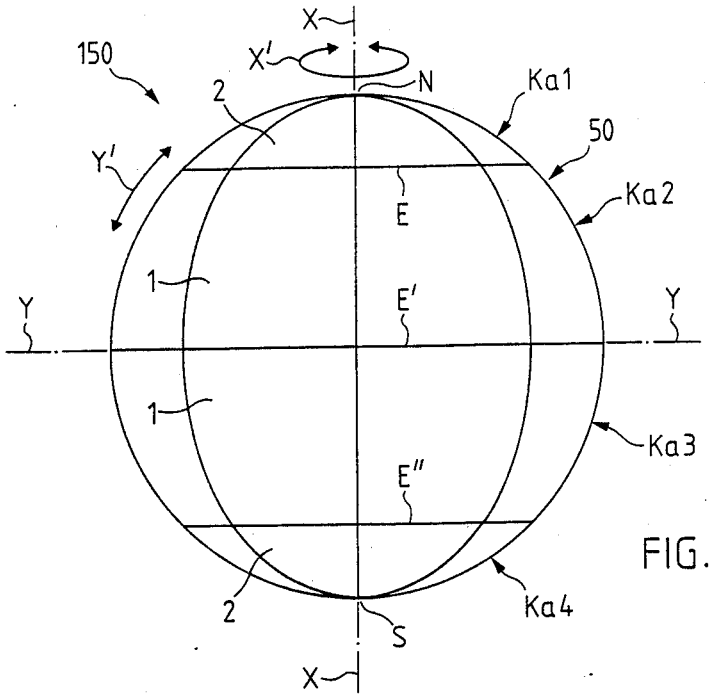
FIG. 1 is a spherically constructed combination in accordance with one embodiment of the invention as shown in elevation.
Figure 2:
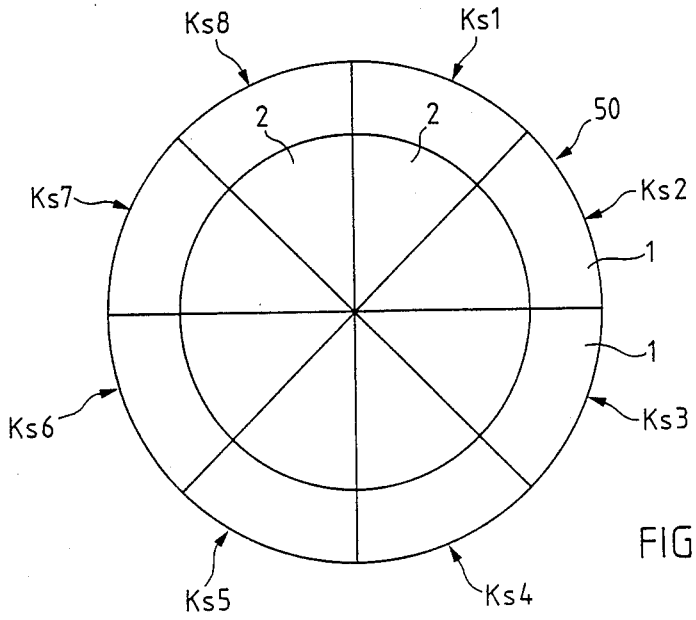
FIG. 2 is a plan view of the toy shown in FIG. 1.

FIG. 1 shows in elevation and FIG. 2 in plan view a combination toy designated overall by 150 and e.g. constructed as a spherical body 50. In this embodiment, spherical body 50 has four individual spherical portions Ka1, Ka2, Ka3 and Ka4 (FIG. 1) formed by sectional planes E,E′ and E″ oriented parallel to one another and eight individual spherical cutouts Ks1, Ks2, Ks3, Ks4, Ks5, Ks6, Ks7 and Ks8 ((FIG. 2). The segmental parts formed by subdivision between an upper pole N and the sectional plane E, as well as between a lower pole S and the sectional plane E″ have an approximately triangular configuration and are designated 2. The other segmental parts formed between sectional plans E and E″ have a roughly trapezoidal configuration and are designated 1. The inner structure of spherical body 50 essentially formed by holding and connecting elements is constructed in such a way that the individual spherical portions Ka1 to Ka4 are rotatable about a fictitious rotations axis X—X in arrow direction X′ and the individual spherical cutouts Ks1 to Ks8 are adjustable about a fictitious axis Y—Y in an arrow direction Y′.

The individual segmental parts 1 and 2 arranged on the circumference of spherical body 50 are reciprocally displaceable, e.g. for reprsenting a picture, a figure or the like and are designated hereinafter as sliding parts 1 or 2.

The structural and functional construction with the corresponding constructional details of the spherical body 50 and the holding and connecting elements (without respecting the numerical sequence of the drawings) will be described in detail hereinafter.

Figure 3:
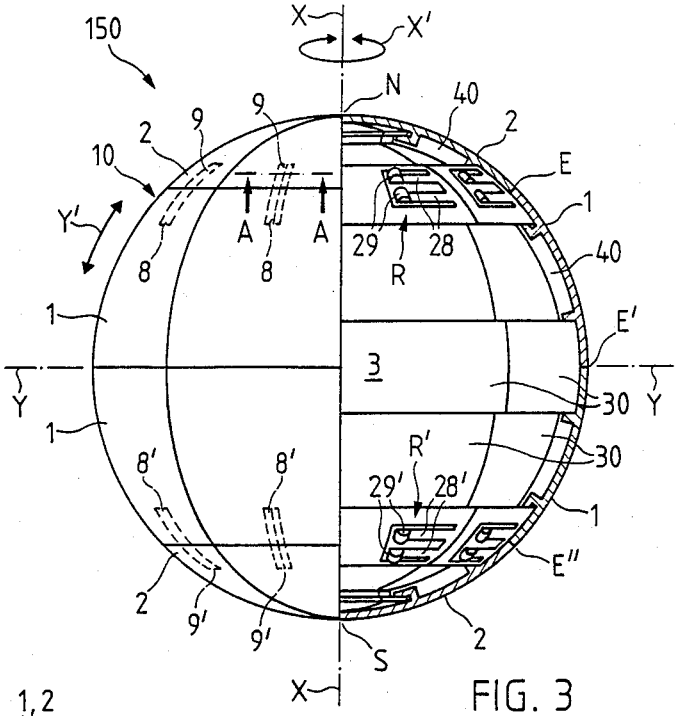
FIG. 3 is a view of the toy of FIG. 1 as shown partially in elevation and partially cut away.
Figure 4:
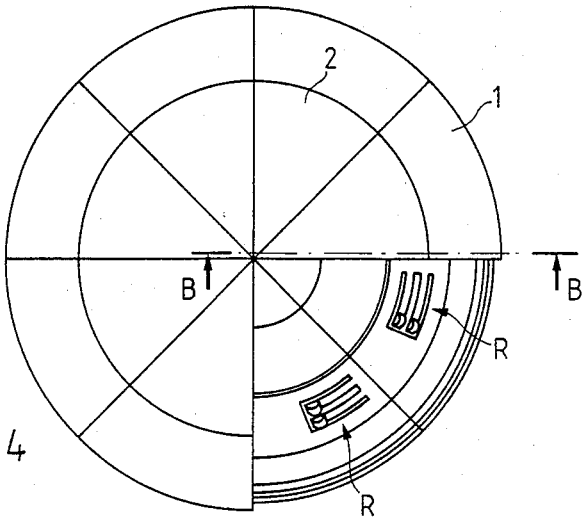
FIG. 4 is a partially cut away plan view of the structure shown in FIG. 2.
Figure 6:
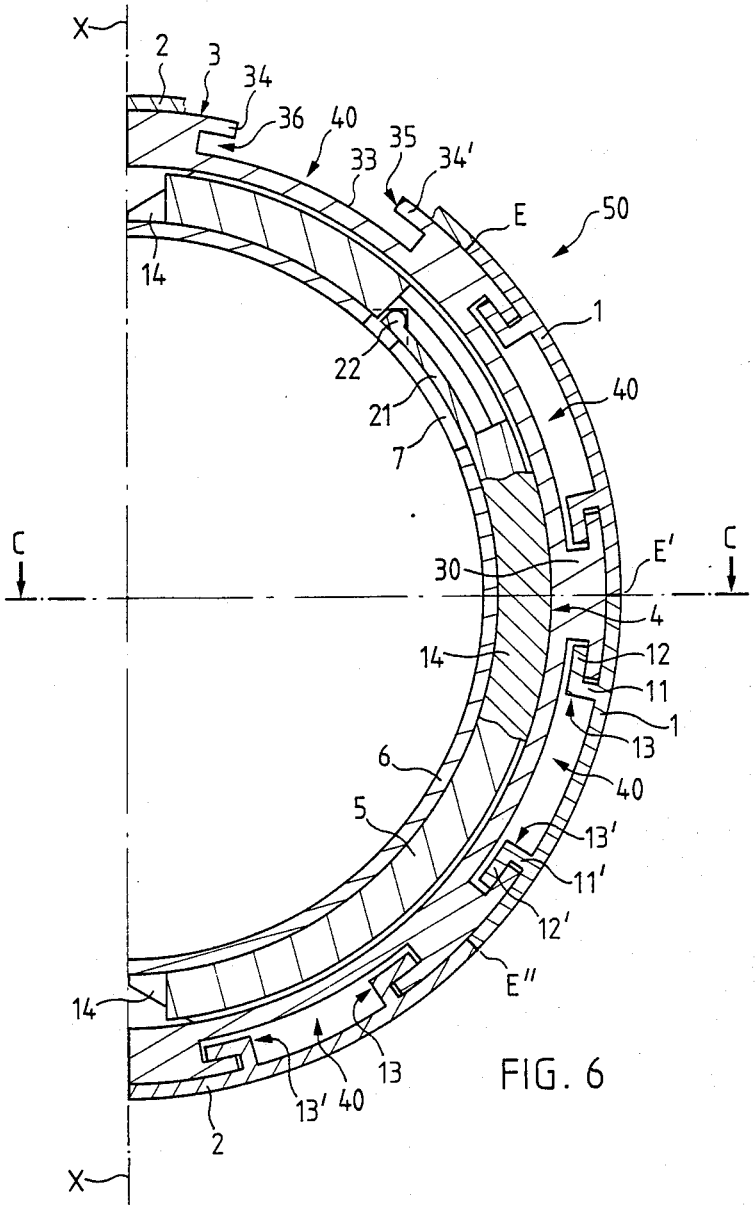
FIG. 6 is an enlarged sectional view along line B—B of FIG. 4.
Figure 7:
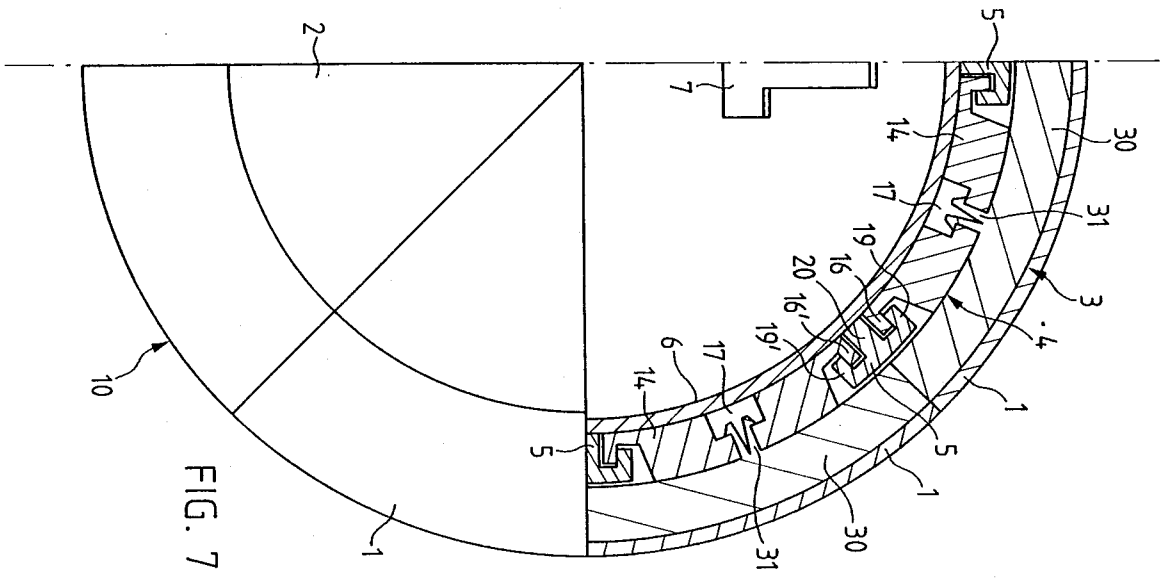
FIG. 7 is an enlarged sectional view along line C—C of FIG. 6.

FIG. 6 shows on a larger scale and in section along line B—B in FIG. 4 and in FIG. 7 along line C—C in FIG. 6 a portion of the spherical body, designated overall 50, it being possible to see an inner spherical body 6, a central spherical body 4 surrounding inner spherical body 6 and formed by several parts 14, as well as an outer spherical body 3 surrounding central spherical body 4 and constituted by several parts 30 and on which in the assembled state are arranged sliding parts 1,2 forming a spherical representation surface 10 (FIG. 3).

Figure 14:
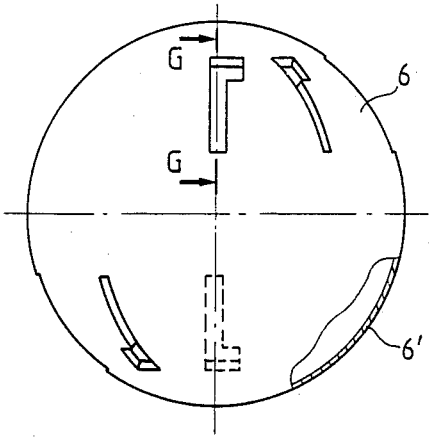
FIG. 14 is an elevation view of the inner spherical body used in the embodiment of FIG. 1.
Figure 16:
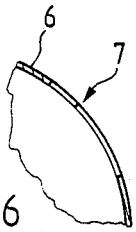
FIG. 16 is a detail view of the inner spherical body taken along line G—G in FIG. 14.
Figure 15:
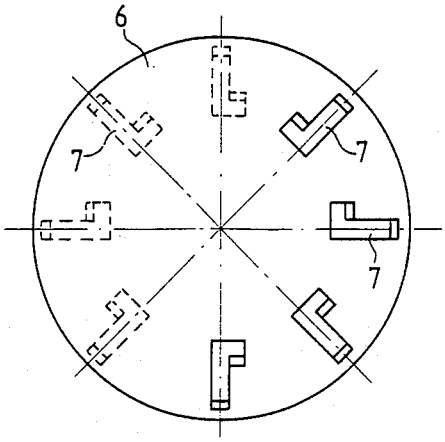
FIG. 15 is a plan view of the body shown in FIG. 14.

The first, inner spherical body 6 shown in elevation and plan view in FIGS. 14 and 15 is constructed e.g. as a one or multi-part and preferably as a one-piece hollow body, which is made from a transparent plastic material or the like. On the circumference of the spherical body 6 is provided a plurality of approximately L-shaped slots 7 arranged in uniformly distributed manner. In the represented embodiment there are in all eight slots, namely four slot above and four slots below (in FIG. 15 represented in broken line form) the centre of the sphere. The L-shaped slot 7 can also be in the form of a recess with a specific depth (not shown) in the spherical body wall 6' or, as shown in section in FIG. 16 along line G—G (FIG. 14), preferably penetrate wall 6'.

The central spherical body designated 4 in FIGS. 6 and 7 comprises several, spherical, shell-like segmental parts 14, which can be interconnected by means of correspondingly constructed connecting elements 5, as shown in profile cross-section in FIG. 7, to give a unit forming the central spherical body 4.

Figure 11:
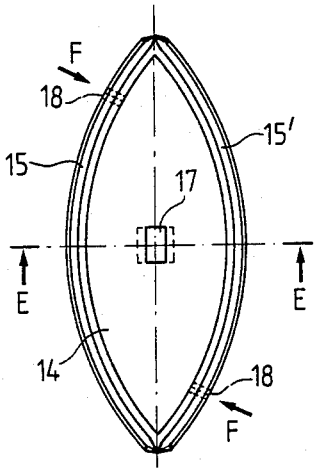
FIG. 11 is a detail view of an inner part used in the embodiment of FIG. 1.
Figure 12:
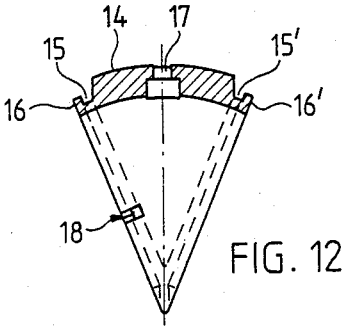
FIG. 12 is a view taken along line E—E in FIG. 11.
Figure 13:
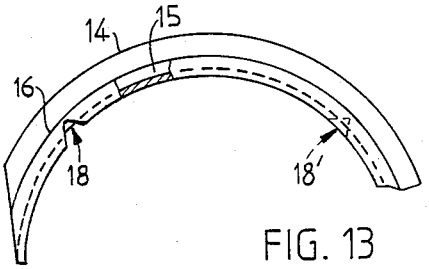
FIG. 13 is an elevation view of the connecting element similar to that of FIG. 8 but showing the grooves in the direction of arrow F of FIG. 11.

A single segmental part 14 of the central spherical body 4 is shown in elevation in FIG. 11 and in profile cross-section along line E—E (FIG. 11) in FIG. 12. Grooves 15, 15' and webs 16, 16' can be seen on either side running parallel to the outer contour, as well as at least one recess 17 which, in the represented embodiment, is positioned approximately in the central region (FIG. 11) of segmental part 14. Additional recesses (not shown) can be provided corresponding to recess 17. Recess 17 penetrating the wall of segmental part 14 is larger on the inside of the segmental part than on the outside thereof (FIG. 12). As is also shown in FIG. 11, there is a notch-like indentation 18, 18' on one side in the lower region and on the other side in the upper region represented on a larger scale in the direction of arrow F in FIG. 13.

Figure 8:
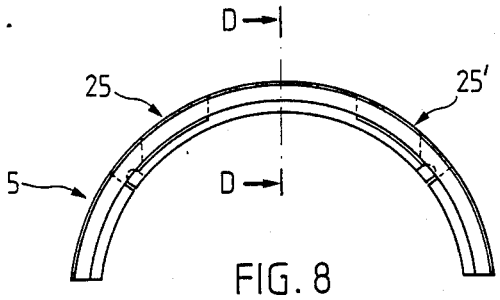
FIGS. 8–10 show a connecting element in elevation, plan view and sectional respectively along the line D—D in FIG. 8.
Figure 10:
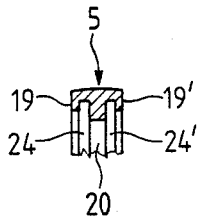
Figure 9:
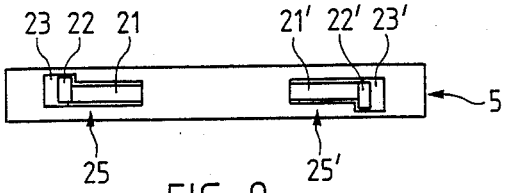

FIGS. 8 and 9 show as a detail a connecting member 5 in elevation and in plan view. The approximately semicircular connecting member 5 corresponding to the central spherical body 4 has, as represented in FIG. 10 in section along line D—D (FIG. 8), an approximately T-shaped profile cross-section, in which two lateral webs 19, 19' are constructed in such a way that in the assembled state, shown on a larger scale in FIG. 7, they engage in the grooves 15, 15' of segmental parts 14. A central web 20 laterally engages on the webs 16, 16' of the particularly segmental part 14. Between the lateral webs 19, 19' and the central web 20 is provided in each case one all-round groove 24, 24', in which engage the webs 16, 16' of the particular segmental part 14 (FIG. 7). On the outer circumference of connecting member 5 are provided at least two, spaced locking elements 25, 25', the individual locking elements 25 or 25' having a spring element 21, 21' arranged in a correspondingly constructed recess 23, 23' and having laterally shaped webs 22, 22''. The spring element 21, 21' substantially formed from the central web 20 of connecting member 5 and arranged in the slot-like recess 23, 23' is constructed in such a way that in the case of an arcuate insertion of the connection member 5 into the particular groove 15, 15' of the individual segmental part 14 cam 22, 22' slides along the inside of said part 14, so that the individual spring element 21, 21' is deflected radially inwards, i.e. into the particular slot 7 of spherical body 6 and remains deflected until it detachably engages in the corresponding indentation 18, 18' of segmental part 14, as a result of the spring-elastic restoring force, in a specific position of cams 22, 22'. Consequently the individual segmental part 14 forms a unit with connecting member 5. The central spherical body 4 comprises eight segmental parts 14 and eight connecting members 5.

The outer spherical body 3 covers the same number of segmental parts as the central spherical body 4. The individual segmental part 30, as shown in larger scale in FIG. 7, has on the inner side facing the central spherical body 4 at least one locking element 31, which engages in snap-like manner in recess 17 of the particular segmental part 14 of the central spherical body 4, so that parts 14 and 30 substantially form a unit. On the outside of the individual acruate segmental part 30 are provided, as shown in FIG. 6, circumferentially oriented, spaced pockets 40. The individual, arcuate pocket 40 is formed by an indentation 36 running parallel to the inside or inner wall with a base 33 and an opening 35 bounded by webs 34, 34'. In the assembled state, in which the individual spherical bodies 6, 4 and 3 are joined together to form a constructional unit, the pockets 40 form a closed, circulating guideway for sliding parts 1, 2 oriented along the great circle.

The individual sliding part 1, 2 which is approximately arcuate on the outside has on the inside facing the individual segmental part 30 of the outer spherical body 3, two spaced guide members 13, 13' engaging in pockets 40 and which are substantially L-shaped, engaging with in each case one approximately radially inwardly directed web 11, 11' in opening 35 and with an approximately circumferentially oriented sliding piece 12, 12' in the indentation 36 of the guideway (pocket 40). The sliding piece 12, 12', as shown in FIG. 6 is guided so as to engage on the inside of webs 34, 34' of opening 35.

Figure 5:
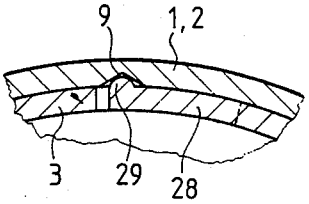
FIG. 5 is a detail view taken in section along line A—A of FIG. 3.

FIG. 3 shows the combination toy 150 partly in elevation and partly broken away. The outer spherical body 3 formed from the individual segmental parts 30, can be seen on one broken away side as well as the sliding parts 1, 2 adjustable about the so-called rotation axis X in arrow direction X' in the pockets 40 of spherical body 3. The entirety of said sliding parts forms the spherical representation surface 10. In the vicinity of the upper separation point E and the lower separation point E'' of the individual sliding parts 1 and 2, there are individual locking devices, which are not shown in greater detail. The locking device essentially comprises notches or grooves 8, 8', or 9,' located on the inside on sliding part 1 or 2, i.e. on the side facing the individual segmental part 30, as well as spring-elastic locking elements R, R' provided on the surface of the individual segmental parts 30. The individual locking element R, R' located in segmental part 30 has two tongues 28, 28' with cams 29, 29' arranged in the recess of the wall of segmental part 30. The tongues 28, 28' are spring-elastic and constructed so as to be deflected approximately radially inwards, engaging through their own, spring-elastic restoring force for a specific position of sliding parts 1 or 2, as shown in detail in FIG. 5, in notices 8, 8' or 9, 9' of the corresponding sliding part 1 or 2.

The locking devices formed essentially from tongues 28, 28' and cams 29, 29' on segmental part 30, as well as the notches 8, 8', 9, 9' on sliding parts 1, 2 are so constructed and arranged that each individual sliding part 1, 2 is in enagement with at least one locking device and in the case of adjustment along the great circles, whereby the tongues 28, 28' are pressed slightly radially inwards, engagement is obtained with the next locking device. An adjusting movement along the meridians is only possible if the sliding parts 1, 2 are congruent with the segmental parts of the two spherical bodies 4, 3.

FIG. 4 shows the combination toy 150 in a partly broken away state wherein the sliding parts 1, 2, as well as the locking elements R can be seen, elements R being diagrammatically represented and distributed in the cut portion in the outer circumference above the outer sphere 3.

While the invention has been described with detailed reference to the drawings, it will be obvious to those skilled in the art that many modifications and changes can be made within the scope and sphere of the invention as defined in the claims which follow.

What is claimed is:

1. A spherical puzzle toy, comprising a substantially spherical multi-part body with a plurality of sliding parts subdivided into great circles and meridian sectional planes and engaging with correspondingly associated and constructed holding and connecting members, said sliding parts being adjustable with respect to one another to assume a specific position on a spherical body surface along the individual great circles and the individual meridians, said multi-part body comprising a first inner spherical body, a second central spherical body, and a third outer spherical body and the sliding parts adjustably arranged thereon, said central spherical body and said outer spherical body being in each case subdivided into an equal number of segmental parts and for performing the adjusting movement along the meridians being operatively interconnected by means of corresponding holding and connecting members and each individual segmental part of the outer spherical body being provided on an outside thereof with spaced pockets which, in the assembled state, form guideways oriented in a circumferential direction and in which are guided the sliding parts adjustable along the great circles, the individual segmental parts of said central spherical body being spherical shell-shaped and being joined together by means of correspondingly constructed, positively engaging connecting members to constitute the central spherical body.

2. The spherical puzzle toy according to claim 1, wherein the inner spherical body is constructed as a one-piece hollow body for the positive reception of the central spherical body.

3. The spherical puzzle toy according to claim 2, wherein the individual segmental parts of the outer spherical body are spherical shell-shaped and are detachably fixed by means of snap-like acting locking elements on the individual segmental parts of the central spherical body.

4. The spherical puzzle toy according to claim 2, wherein each individual segmental part of said central spherical body is provided on either side with a groove and web oriented parallel to the outer contour and the connecting members therefor are each in the form of a connecting member provided with a web positively engaging in a corresponding one of said grooves.

5. The spherical puzzle toy according to claim 2, wherein the inner spherical body is constructed as a constructional unit with the central and outer spherical bodies formed from the individual, positively connected segmental parts.

6. The spherical toy puzzle according to claim 2, wherein each individual sliding part has on the side facing the outer spherical body in each case two spaced guide members engaging in a positive manner in the pocket of a segmental part of said outer spherical body.

7. The spherical puzzle toy according to claim 1, wherein the individual segmental parts forming the outer spherical body are of spherical shell shape and are detachably fixed by means of snap-like-acting locking elements on the individual segmental parts of the central spherical body.

8. The spherical puzzle toy according to claim 1, wherein each individual segmental part of said central spherical body is provided on either side with a groove and web oriented parallel to the outer contour and the connecting members therefor are each in the form of a connecting member provided with a web positively engaging in a corresponding one of said grooves.

9. The spherical puzzle toy according to claim 8, wherein each said connecting member is semicircular and T-shaped in profile cross-section and is provided on an outer circumference thereof with at least one locking element, which in the assembled state engages in a notch-like indentation of an adjacent one of said segmental parts.

10. The spherical puzzle toy according to claim 1, wherein the inner spherical body is constructed as a constructional unit with central and outer spherical bodies formed from the individual, positively connected segmental parts.

11. The spherical puzzle toy according to claim 1, wherein each individual sliding part has on the side facing the outer spherical body in each case two spaced guide members engaging in a positive manner in the pocket of a segmental part of said outer spherical body.

12. The spherical puzzle toy according to claim 11, wherein the guide member shaped on each said sliding part is constructed L-shaped in profile cross-section and positively engages with a larger, web-like portion in the pocket of said segmental part.

13. The spherical puzzle toy according to claim 1, wherein on the inside said said sliding parts are provided with notches and engage with locking means located on the segmental parts of said outer spherical body and essentially formed from tongues and cams, so that the sliding parts are adjustable in the direction of the great circles engaging from one to the other outer segmental part counter to a restoring force of spring-elastic parts.

14. The spherical puzzle toy according to claim 1, wherein the individual parts are made from plastic by injection moulding.

15. The spherical puzzle toy according to claim 1, wherein the individual segmental parts of the outer spherical body are spherical shell-shaped and are detachably fixed by means of snap-like-acting locking elements on the individual segmental parts of the central spherical body.

* * * * *